US005521047A

United States Patent [19]

Yuh et al.

[11] Patent Number: 5,521,047

[45] Date of Patent: May 28, 1996

[54] PROCESS FOR PREPARING A MULTILAYER ELECTROPHOTOGRAPHIC IMAGING MEMBER

[75] Inventors: Huoy-Jen Yuh, Pittsford; John S. Chambers, Rochester, both of N.Y.

[73] Assignee: Xerox Corporation, Stamford, Conn.

[21] Appl. No.: 455,242

[22] Filed: May 31, 1995

[51] Int. Cl.[6] ..... G03G 5/043

[52] U.S. Cl. ..... 430/134; 430/132

[58] Field of Search ..... 430/59, 134, 132

[56] References Cited

U.S. PATENT DOCUMENTS

| | | | |
|---|---|---|---|
| 4,082,551 | 4/1978 | Steklenski et al. | 430/56 |
| 4,265,990 | 5/1981 | Stolka et al. | 430/59 |
| 4,521,457 | 6/1985 | Russell et al. | 427/286 |
| 4,571,371 | 2/1986 | Yashiki | 430/62 |
| 4,579,801 | 4/1986 | Yashiki | 430/60 |
| 4,587,189 | 5/1986 | Hor et al. | 430/59 |
| 4,855,203 | 8/1989 | Badesha et al. | 430/59 |
| 5,350,654 | 9/1994 | Pai et al. | 430/59 |
| 5,395,722 | 3/1995 | Nukada et al. | 430/59 |

*Primary Examiner*—John Goodrow
*Attorney, Agent, or Firm*—Oliff & Berridge

[57] ABSTRACT

An electrophotographic imaging member having a perylene-containing charge generating layer is prepared by forming a dispersion of a perylene charge generating material in an acetate solvent and applying the dispersion to an electrophotographic imaging member layer by solution coating. An imaging member is prepared by forming an interphase region between a charge generating layer and a charge transport layer.

10 Claims, No Drawings

PROCESS FOR PREPARING A MULTILAYER ELECTROPHOTOGRAPHIC IMAGING MEMBER

BACKGROUND OF THE INVENTION

This invention relates in general to electrophotography and, in particular, to a process for preparing electrophotoconductive imaging members having multiple layers.

In electrophotography, an electrophotographic plate, drum, belt or the like (imaging member) containing a photoconductive insulating layer on a conductive layer is imaged by first uniformly electrostatically charging its surface. The imaging member is then exposed to a pattern of activating electromagnetic radiation such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a support, such as paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. A layered photoreceptor having separate photogenerating and charge transport layers is disclosed in U.S. Pat. No. 4,265,990. The photogenerating layer is capable of photogenerating charge and injecting the photogenerated charge into the charge transport layer.

Degradation of image quality is encountered during extended cycling with more advanced, higher speed electrophotographic copiers, duplicators and printers. Complex, highly sophisticated higher speed duplicating and printing systems place stringent requirements on photoreceptors. These requirements impose narrow operating limits.

The numerous layers found in many modern photoconductive imaging members must be highly flexible, adhere well to adjacent layers and exhibit predictable electrical characteristics within narrow operating limits to provide excellent toner images over many thousands of cycles. One type of multilayered photoreceptor that has been employed as a bet in electrophotographic imaging systems comprises a substrate, a conductive layer, a blocking layer, an adhesive layer, a charge generating layer, and a charge transport layer. This photoreceptor may also comprise additional layers such as an anti-curl backing layer and an overcoating layer.

Suitable and economical coating methods used for applying layers in multi-layer electrophotographic imaging members include dip coating, roll coating, Meyer bar coating, bead coating, curtain flow coating and vacuum deposition. Solution coating is a preferred approach because it is more economic than vacuum coating and can be used to deposit a seamless layer.

U.S. Pat. No. 4,082,551 to Steklenski et al. discloses a process of coating multiple layers onto an insulating, polyester substrate by applying solutions having dissolved coating substance and drying each applied layer before coating a subsequent layer. The coated elements, when tested, indicate no chemical interaction between the photogenerating and conducting layers and essentially no change in electrical resistivity of the conducting layer.

U.S. Pat. No. 4,571,371 to Yashiki discloses an electrophotographic photosensitive member having a charge generating layer and a charge transport layer. A dispersion of charge generating material dissolved in solvent is applied to a cured polyamide resin layer by soaking and drying at 100° C. for 10 minutes to form a charge generating layer. Subsequently, a solution containing a charge transfer material is applied to the dried charge generating layer followed by drying at 100° C. for 60 minutes.

U.S. Pat. No. 4,579,801 to Yashiki discloses a process for applying a dispersion of charge generating material in a solution containing a binder resin to a suitable substrate or dried underlayer. The charge generation layer can be formed by vapor deposition. Yashiki suggests that a charge transporting material, dissolved in a solution of resin, can be applied using conventional methods to form a thin film.

U.S. Pat. No. 4,521,457 to Russell et al. discloses a process for simultaneously constraining two different coating materials, and forming on a substrate a continuous, unitary layer comprising adjacent "ribbons." Each ribbon is comprised of different materials and is in edge-to-edge contact with an adjacent ribbon. The coated ribbons are dried in two zones, one at about 57° C. and another at about 135° C.

U.S. Pat. No. 4,855,203 to Miyaka teaches applying charge generating layers from coating solutions comprising a resin dispersed pigment. Suitable pigments include photoconductive zinc oxide or cadmium sulfide and organic pigments such as a phthalocyanine type pigment, a polycyclic quinone type pigment, a perylene pigment, an azo type pigment and a quinacridone type pigment. Miyaka discloses suitable organic solvents for preparing a coating solution of the pigments as including alcohols such as methanol, ethanol and isopropanol; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane and ethylene glycol monomethyl ether; esters such as methyl acetate and ethyl acetate; aliphatic halogen hydrocarbons such as chloroform, methylene chloride, dichloroethylene, carbon tetrachloride and trichloroethylene; or aromatic compounds such as benzene, toluene, xylene, ligroin, monochlorobenzene and dichlorobenzene.

Markovics et al., co-pending U.S. application Ser. No. 07/932,150, filed Aug. 19, 1992, now U.S. Pat. No. 5,476,740 Markovics et al., U.S. Application Ser. No. 08/195,427, allowed filed Feb. 14, 1994 and Nealey et al., U.S. application Ser. No. 08/414,163, filed Mar. 31, 1995, pending disclose processes for preparing an electrophotographic imaging member including the step of forming an interphase region.

Conventional electrophotographic imaging members, having at least a charge generating layer and a charge transport layer suffer numerous disadvantages. For example, electrophotographic imaging members can suffer from poor charge acceptance and can have limited photosensitivity due to limited injection of charge generated by absorbed photons into the charge transport layer. In addition, charge transport materials may diffuse and come in contact with the conductive layer, adversely affecting the electrophotographic imaging member. Notably, devices manufactured using conventional processes have limited photoresponse.

Photoreceptors with perylene charge generating pigments, particularly benzimidazole perylene, show superior performance with extended life. The perylene containing charge generating layers can be applied by a vacuum coating process. Vacuum coated charge generating layers containing perylenes show a high photosensitivity. However, vacuum coating is expensive.

Solution coating is a more economical and convenient method of applying charge generating layers. However, perylene pigments are difficult to disperse and unstable dispersions are encountered with coating perylene pigment charge generating layers from solution. Unstable dispersions cause pigment flocculating and settling that leads to coating quality problems. Unstable dispersions are difficult to process, especially in a dip coating process. Dip coated perylene containing charge generating layers show the substantial depreciation in sensitivity described above.

SUMMARY OF THE INVENTION

The invention is directed to a process for preparing an electrophotographic imaging member having a perylene-containing charge generating layer. The process comprises forming a dispersion of a perylene pigment and a polyvinylbutyral binder in an acetate solvent and applying the dispersion to an electrophotographic imaging member layer by solution coating. The process may comprise applying the dispersion to form a wet underlying layer and overcoating a charge transport layer on the underlying charge generating layer prior to drying the charge generating layer to allow charge transport material in the charge transport layer to diffuse into the wet underlying charge generating layer to form an interphase region comprising a mixture of perylene charge generating material and charge transport material. The present invention provides electrophotographic imaging members that enhance the injection of photogenerated charge into the charge transport layer. The interphase region comprises perylene charge generating material and charge transport material.

DETAILED DESCRIPTION OF PREFERRED EMBODIMENTS

The present invention relates to a method of solvent coating charge generating layers containing perylene pigments to produce a photoreceptor with improved sensitivity. The present invention provides a process for preparing a multi-layer electrophotographic imaging member having a perylene-containing charge generating layer that can be applied by solution coating from stable solutions and that results in perylene containing charge generating layers of improved sensitivity.

The present invention relates to a process for preparing an electrophotographic imaging member having a perylene-containing charge generating layer comprising dispersing a perylene charge generating material in an acetate solvent with polyvinylbutyral binder to form a dispersion and applying the dispersion to form the charge generating layer. Preferred acetate solvents include n-butylacetate, ethylacetate, isopropylacetate and methylacetate. Unexpectedly, it has been found that perylenes form stable dispersions in acetate solvent for the purposes of application by solvent coatings such as dip coating. Further, it has been found that photoreceptors that include charge generating layers containing perylene charge generating materials applied from dispersions in acetate solvent display an increased sensitivity. For example, a 30% increase in sensitivity is obtained when a benzimidazole perylene dispersion in n-butylacetate is dip coated onto a photoreceptor to form a charge generating layer as compared to a photoreceptor having a charge generating layer prepared from a BZP dispersion in cyclohexanone.

A representative electrophotographic imaging member may include a supporting substrate, optional adhesive layer(s), a conductive layer, a blocking layer, a perylene-containing charge generating layer, an interphase region and a charge transport layer. Other combinations of layers suitable for use in electrophotographic imaging members are also within the scope of the invention. For example, an anti-curl backing layer and/or a protective overcoat layer may also be included, and/or the substrate and conductive layer may be combined. Additionally, a ground strip may be provided adjacent the charge transport layer at an outer edge of the imaging member. The ground strip is coated adjacent to the charge transport layer so as to provide grounding contact with a grounding device.

The substrate, conductive layer, blocking layer and adhesive layer(s), if incorporated into an electrophotographic imaging member according to the present invention, may be prepared and applied using conventional materials and methods.

An electrophotographic imaging member according to the present invention comprises a perylene-containing charge generating layer, a charge transport layer and an interphase region between the charge generating layer and the charge transport layer. The interphase region contains a mixture of charge transport material and charge generating material.

In one embodiment, the interphase region is formed by applying a charge transport material to an underlying layer of perylene-containing charge generating material, prior to drying or curing the underlying layer.

Application of charge transport material before the underlying layer has completely dried or cured can produce the interphase region comprising a mixture of the charge generating material and the charge transport material. This method permits the charge transport material and/or the charge generating material to migrate across the charge transport layer/charge generating layer interface to form the interphase region, thereby increasing the photosensitivity of the resulting imaging member. Such an interphase region can have the charge generating material and the charge transport material mixed on a molecular level.

The interphase region, preferably having the perylene-containing charge transport material in an increasing gradient layer on a molecular level in a direction approaching the charge transport, may enhance the injection of photogenerated charge from the charge generating material into the charge transport layer to enhance the charge transport efficiency throughout the charge generating layer.

A gradual mixing of the perylene-containing charge generating material and the charge transport material in the interphase region between the charge generating layer and the charge transport layer can be achieved by diffusion of the charge transport material into solvent-rich, undried charge generating layer during the coating process.

The gradient transition between the charge generating layer and the charge transport layer significantly enhances the photoresponse of the electrophotographic imaging member and provides remarkably improved performance over imaging members produced using conventional means. The mixture in the interphase region is preferably characterized by a decreasing gradient of charge generating material and an increasing gradient of charge transport material in the direction of the charge transport layer of the electrophotographic imaging member. In another related embodiment, the charge transport layer can contain a minor amount (relative to the charge transport material) of a charge generating material, and/or the charge generating layer can contain a minor amount (relative to the charge generating material) of a charge transport material.

The composition of the interphase region may be directly controlled by the specific type of process used to apply the underlying charge generating layer and the charge transport layer. For example, a method for simultaneously applying the charge generating material and the charge transport material controls the concentration of the charge generating material and the charge transport material at various depths in the interphase region. Specifically, a spraying apparatus fed by two reservoirs respectively containing charge generating material and charge transporting material may be passed over a suitable substrate several times. The amount of charge generating material may be decreased and the amount of charge transport material increased so that, with each successive pass, a gradual transition from charge generating material to charge transporting material is achieved, thus producing the interphase region gradient.

Generally, the cumulative thickness of the layers in a multi-layered electrophotographic imaging member does not exceed 30 micrometers. Therefore, preferred interphase region thicknesses range from about 0.1 micrometer to about 10 micrometers.

Any suitable perylene-containing charge generating material may be applied to the substrate or other layer. The charge generating materials for use in the present invention are compositions comprising a perylene pigment. The perylene pigment is dissolved in an acetate solvent for application of the charge generating layer. Preferably, the perylene pigment is dispersed in a film forming binder and the resulting dispersion is dissolved in the acetate solvent.

Examples of photogenerating pigments include, but are not limited to the perylene pigments disclosed in U.S. Pat. No. 4,587,189, the disclosure of which is incorporated herein by reference. Benzimidazole perylene is a preferred pigment. The benzimidazole perylenes include the following structures:

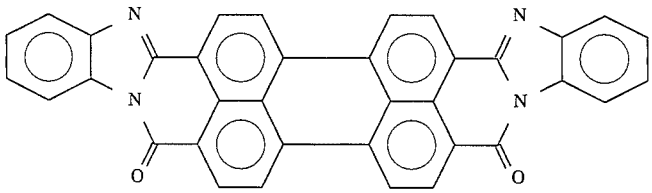

and

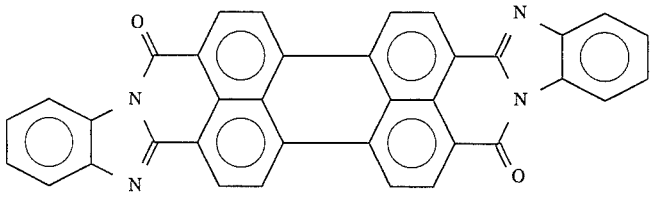

Any suitable polymeric film-forming binder material may be employed as a matrix in the charge generating layer. The binder polymer preferably 1) adheres well to the substrate or other underlying layer; and 2) dissolves in the acetate solvent. Examples of materials useful as the film-forming binder include, but are not limited to, polyvinylcarbazole, phenoxy resin, polycarbonate, polyvinylbutyral, polystyrene, polystyrenebutadiene and polyester. Polyvinylbutyral is the preferred binder polymer.

The acetate solvent is a lower alkylacetate. Preferrably the alkyl has 1 to 4 carbon atoms. Examples of acetate solvents include methylacetate, ethylacetate, isopropylacetate, n-propylacetate, n-butylacetate, sec-butylacetate and tert-butylacetate. The preferred acetate solvent is n-butylacetate.

Generally, from about 5 percent by volume to about 95 percent by volume of the perylene pigment is dispersed in no more than about 95 percent by volume of the film-forming binder. In one embodiment, a volume ratio of the photogenerating pigment and film-forming binder is about 1:12, corresponding to about 8 percent by volume of the photogenerating pigment dispersed in about 92 percent by volume of the film-forming binder. In another embodiment, the volume ratio of the film-forming binder and photogenerating pigment is about 1:9 corresponding to about 90 percent of the photogenerating pigment dispersed in about 10 percent binder.

Exemplary charge generating layer thicknesses according to the present invention include, but are not limited to, thicknesses ranging from about 0.1 micrometer to about 5.0 micrometers, and preferably from about 0.3 micrometer to about 3 micrometers. Charge generating layer thickness generally depends on film-forming binder content. Higher binder content generally results in thicker layers for photogeneration. Thicknesses outside the above exemplary ranges are also within the scope of the invention.

The charge transport layer comprises any suitable organic polymer or non-polymeric material capable of transporting charge to selectively discharge the surface charge. It may not only serve to transport charge, but may also protect the imaging member from abrasion, chemical attack and similar destructive elements, thus extending the operating life of the electrophotographic imaging member. Alternatively or in addition, a protective overcoat layer may provide these protective functions.

The charge transport layer should exhibit negligible, if any, discharge when exposed to a wavelength of light useful in xerography, e.g. 4000 Angstroms to 9000 Angstroms. Therefore, the charge transport layer is substantially transparent to radiation in a region in which the photoreceptor operates.

Charge transport materials for use in the invention are preferably compositions comprising a hole transporting material dispersed in a resin binder and dissolved in a solvent for application.

Hole transporting materials for use in compositions according to the present invention include, but are not limited to, a mixture of one or more transporting aromatic amines, hydrozons, etc. Exemplary aromatic amines include triaryl amines such as triphenyl amines, poly triaryl amines, bisarylamine ethers and bisalkylaryl amines.

Preferred bisarylamine ethers include, but are not limited to, bis (4-diethylamine-2-methylphenyl) phenylmethane and 4'-4"-bis(diethylamino)-2'2"dimethyltriphenylmethane. Preferred bisalkylaryl amines include, but are not limited to, N,N'-bis (alkylphenyl)(1,1'-biphenyl)-4,4'-diamine wherein the alkyl is, for example, methyl, ethyl, propyl, n-butyl, and the like. Meta-tolyl-bis-diphenylamino benzadine and N,N'-diphenylN,N'-bis (3"-methylphenyl)-(1,1'biphenyl)-4,4'-diamine are preferred transporting aromatic amines.

Exemplary resin binders used in charge transport compositions according to the present invention include, but are not limited to polycarbonate, polyvinylcarbazole, polyester, polyarylate, polyacrylate, polyether and polysulfone. Molecular weights of the resin binders can vary from about 20,000 to about 1,500,000.

Preferred resin materials are polycarbonate resins having molecular weights from about 20,000 to about 120,000, more preferably from about 50,000 to about 100,000. Highly preferred resin materials are poly(4,4'dipropylidene-diphenylene carbonate) with a molecular weight of from about 35,000 to about 40,000, available as Lexan 145 from General Electric Company; poly(4,4'isopropylidene-diphenylene carbonate) with a molecular weight of from about 40,000 to about 45,000, available as Lexan 141 from General Electric Company; polycarbonate resin having a molecular weight of from about 50,000 to about 100,000, available as Makrolon from Farben Fabricken Bayer A. G.; polycarbonate resin having a molecular weight of from about 20,000 to about 50,000 available as Merlon from Mobay Chemical Company; polyether carbonates; and 4,4'-cyclohexylidene diphenyl polycarbonate.

Solvents useful to form charge transport layers according to the present invention include, but are not limited to, monochlorobenzene, tetrahydrofuran, cyclohexanone, methylene chloride, 1,1,1-trichloroethane, 1,1,2-trichloroethane, dichloroethylene, toluene, and the like. Monochlorobenzene is a desirable component of the charge transport layer coating mixture for adequate dissolving of all the components and for dip coating applications.

An especially preferred charge transport layer material for multi-layer photoconductors comprises from about 25 percent to about 75 percent by weight of at least one charge transporting aromatic amine, and about 75 percent to about 25 percent by weight of a polymeric filmforming resin in which the aromatic amine is soluble.

As discussed above, an exemplary mechanism for mixing charge generating material and charge transport material to form an interphase region according to the present invention comprises molecular mixing in which charge transport material migrates across the charge generating material/charge transport material interface to achieve a gradient of charge transport material in the interphase region, and combinations of this and other mechanisms. Combinations of charge generating material and charge transport material in an electrophotographic imaging member according to the present invention preferably include materials which are capable of molecular mixing.

In a process of the invention for producing the electrophotographic imaging member having an interphase region, a perylene-containing charge generating layer is applied from an organic acetate solution to form an underlying layer; the underlying layer is overcoated, prior to drying, with a charge transport material to form a charge transport layer; the charge transport material is allowed to diffuse into the undried underlying layer; and the underlying layer and charge transport layer are dried or cured to fix the interphase region having a mixture of a charge generating material and a charge transport material. Another exemplary process according to the invention, which permits control of the concentration of the charge generating material and charge transport material in the interphase region, includes simultaneously applying the charge generating material and charge transport material and decreasing the amount of the charge generating material while increasing an amount of the charge transport material.

Any suitable technique, which has been appropriately selected and/or modified in accordance with the process herein described, may be utilized to mix and thereafter apply any of the charge generating layer composition, the charge transport layer composition or simultaneously applied charge generating material and charge transport material layer to the substrate or other underlying layer. Typical application techniques include spray coating, dip coating, roll coating, Meyer bar coating, bead coating, curtain flow coating and the like.

Drying of the deposited coating can be carried out by any suitable conventional technique to remove solvent from an applied layer or interphase region. Non-limiting examples of drying techniques include oven drying, infrared radiation drying, air drying and the like. When the coating is dried, it may be dried at room temperature or elevated temperature. In the embodiment in which the charge transport layer is applied to the charge generating layer prior to drying, the charge transport layer can be applied immediately after application of the charge generating layer or can be applied to a partially or nearly completely solidified charge generating layer. In the embodiment wherein the charge generating material and charge transport material are simultaneously applied, the materials may be applied to a dried charge generating layer or to a partially or completely dried charge generating layer. Correspondingly, the applied interphase region may be completely or only partially dried prior to application of the charge transporting layer. Each layer can be applied to a previously applied layer in the wet state or in any state including a dry or nearly solidified state.

A previously applied layer may be dried for a period of 0 to 20 minutes or longer before application of the next layer. In various embodiments of the invention, a previously applied layer may be dried for a period of 0 to 20 minutes, 5 to 15 minutes or 10 to 12 minutes. In some embodiments, the previously applied layer can be dried for a period of 0 to 5 minutes or 0 to 10 minutes or 18 to 20 minutes or 15 to 18 minutes. The period of drying will depend upon the conditions of drying. Additionally, the period of drying will depend upon the physical state of the previously applied layer necessary to carry out the objectives of the process of the invention.

The invention will further be illustrated in the following examples, it being understood that these examples are illustrative only and that the invention is not limited to the materials, conditions, process parameters and the like recited therein.

EXAMPLE 1

A nylon charge blocking layer is fabricated from an 8 weight % solution of nylon in butanol, methanol and water mixture. The butanol, methanol and water mixture percentages are 55, 36 and 9 weight % respectively. A charge generating layer is prepared from a 3% by weight solids solution of benzimidazole perylene and polyvinylbutyral B79 (Mansanto Chem. Co.) (68/32 weight % ) in n-butylacetate. The dispersion is prepared by roll milling the pigment/B79/n-butylacetate solution for 5 days in a bottle charged with ⅛" dia. stainless steel shot. A charge transport layer is prepared from a 20% by weights solids solution of N,N'diphenyl-N,N'-bis(3-methylphenyl)-( 1,1 '-biphenyl)-4, 4'diamine and poly(4,4'-diphenyl-1,1'-cyclohexane carbonate) (35/65 weight %) in monochlorobenzene.

The charge blocking layer is dip coated onto an aluminum substrate and is dried at a temperature of about 105° C. for about 5 minutes. The dried nylon containing blocking layer has a thickness of about 1.5 micron. The charge generating layer is then coated onto the charge blocking layer and allowed to air dry for 5 minutes. The layer thickness is about 0.5 micron. The charge transport layer is dip coated onto the charge generating layer and is dried at about 130° C. for about 60 minutes. The dried charge transport layer has a thickness of about 20 micron. For comparison, a sister photoreceptor sample is prepared by the same method as above, except that the charge generating layer is dried at 110° C. for 10 minutes.

The two samples are tested in a cyclic scanner at ambient conditions, i.e., about 25° C., for photosensitivity. The device is first charged with a scorotron to 600 V, then is exposed to a light of 670 nm wavelength 0.47 sec. after charging. Light intensity is varied to monitor the surface voltage change amount. Photosensitivity is calculated by dividing the amount of surface voltage change by the exposed light intensity.

A 30% increase in sensitivity is achieved when dip coating the benzimidazole perylene dispersion (in polyvinylbutyral binder) from n-butylacetate instead of cyclohexanone. A further increase in sensitivity is achieved by eliminating the drying step between the charge generating layer and charge transport layer and coatings. The n-butylacetate dispersion is stable (newtonian with no yield point) over a long period of time with no particle size or rheological property change over a three month monitoring period. No streak or other coating defects known to be associated with charge generating layer dispersion qualities are observed. The dispersion can be manufacturable in large quantities by a dynomilled process.

Consistent sensitivity values are observed with photoreceptor devices coated periodically over a three month time frame. The devices are remeasured 3 months after fabrication and the sensitivity remains unchanged. The 140 V.cm$^2$/ergs sensitivity for a 20 micron thick device is satisfactory for a commercial product. Eliminating of the charge generating layer drying step reduces cycle time and reduces photoreceptor cost.

| Device | dV/dX(V · cm$^2$/ergs) measured at t = 0 | dV/dX(V · cm$^2$/ergs) measured 2 months later |
|---|---|---|
| Dried Charge Generating Layer Coated From Cyclohexanone | 65 | 65 |
| Dried Charge Generating Layer Coated From n-butylacetate | 110 | 114 |
| Dried Charge Generating Layer coated from n-butylacetate | 112 | 105 |
| No Dry Charge Generating Layer Coated From n-butylacetate | 135 | 138 |

-continued

| Device | dV/dX(V · cm$^2$/ergs) measured at t = 0 | dV/dX(V · cm$^2$/ergs) measured 2 months later |
|---|---|---|
| No Dry Charge Generating Layer Coated From n-butylacetate | 149 | 141 |

While the invention has been described with reference to particular preferred embodiments, the invention is not limited to the specific examples given and other embodiments and modifications can be made by those skilled in the art without departing from the spirit and scope of the invention and claims.

What is claimed is:

1. A process for preparing an electrophotographic imaging member having a perylene-containing charge generating layer comprising dispersing a perylene charge generating material in an acetate solvent to form a dispersion; applying said dispersion to form said charge generating layer; and forming an interphase region comprising a mixture of perylene-containing charge generating material and charge transport material between said perylene-containing charge generating layer and a charge transport layer.

2. The process according to claim 1, comprising:

a) applying the perylene-containing charge generating material to form a wet underlying layer; and b) overcoating a charge transport material on the underlying layer prior to drying to form said charge transport layer and said interphase region.

3. The process according to claim 1, wherein the step of forming an interphase region comprises simultaneously applying perylene-containing charge generating material and charge transport material.

4. The process according to claim 1, wherein an amount of the perylene-containing charge generating material is decreased and an amount of the charge transport material is increased as the materials are applied in said interphase forming step.

5. The process according to claim 1, comprising:

a) applying the perylene-containing charge generating material;

b) forming said interphase region by applying a decreasing amount of perylene-containing charge generating material and an increasing amount of charge transport material to form a gradient mixture of charge generating material and charge material; and (c) applying the charge transport material.

6. The process according to claim 1, wherein the interphase region is formed by applying a material by spray coating, dip coating, roll coating, Meyer bar coating, bead coating or curtain flow coating.

7. The process according to claim 1, wherein said perylene charge generating material is dispersed with a polyvinylbutyral binder in said acetate solvent.

8. The process according to claim 1, wherein said acetate solvent is selected from the group consisting of methylacetate, ethylacetate, isopropylacetate, n-propylacetate, n-butylacetate, sec-butylacetate and tert-butylacetate.

9. The process according to claim 1, wherein said acetate solvent is n-butylacetate.

10. The process according to claim 1, wherein said perylene-containing charge generating layer is a benzimidazole-containing charge generating layer.

* * * * *